US008029255B2

(12) United States Patent
Morozumi et al.

(10) Patent No.: US 8,029,255 B2
(45) Date of Patent: Oct. 4, 2011

(54) LUBRICATING OIL CIRCULATING DEVICE FOR COMPRESSOR

(75) Inventors: Naoya Morozumi, Kawasaki (JP); Yasuhiro Sakakibara, Kawasaki (JP); Makoto Araki, Kawasaki (JP); Hiroki Tomoda, Kawasaki (JP); Toshihiko Fukuda, Kawasaki (JP)

(73) Assignee: Fujitsu General Limited, Kawasaki-Shi, Kanagawa-Ken (JP)

( * ) Notice: Subject to any disclaimer, the term of this patent is extended or adjusted under 35 U.S.C. 154(b) by 1111 days.

(21) Appl. No.: 11/266,279

(22) Filed: Nov. 4, 2005

(65) Prior Publication Data

US 2006/0099086 A1 May 11, 2006

(30) Foreign Application Priority Data

Nov. 5, 2004 (JP) ..... 2004-321530

(51) Int. Cl.
*F04C 18/02* (2006.01)
*F04C 2/00* (2006.01)

(52) U.S. Cl. ..... 418/55.6; 418/55.1; 418/94; 184/6.18

(58) Field of Classification Search ..... 418/55.1–55.6, 418/57, 94, 88, 89, 100, DIG. 1; 184/6.16, 184/6.18

See application file for complete search history.

(56) References Cited

U.S. PATENT DOCUMENTS 4,838,773 A * 6/1989 Noboru ..... 418/55.5
6,135,738 A * 10/2000 Kajiwara et al. ..... 418/55.4

FOREIGN PATENT DOCUMENTS

JP 2000080990 A * 3/2000
JP 2000120569 A * 4/2000
JP 2001003884 A * 1/2001
JP 2002161880 A * 6/2002

OTHER PUBLICATIONS

JP 2000-080990 A (Mar. 2000) Hara et al.—English Translation.*
JP 2000-120569 A (Apr. 2000) Kajiwara et al.—English Translation.*

* cited by examiner

*Primary Examiner* — Theresa Trieu
(74) *Attorney, Agent, or Firm* — Manabu Kanesaka

(57) ABSTRACT

It provides at a low price a compressor capable of preventing a waste oil pipe from falling off and curbing leakage of lubricating oil and oscillation of the pipe. An L-shaped waste oil pipe 8 for returning lubricating oil 20 to a bottom of a motor chamber 22 is connected to a waste oil passage 33 of a main frame 3 so as to put at least a part of the waste oil pipe 8 in elastic contact with an internal surface of an airtight container 2.

3 Claims, 9 Drawing Sheets

LUBRICATING OIL CIRCULATING DEVICE FOR COMPRESSOR

TECHNICAL FIELD

The present invention relates to a compressor used for a refrigeration cycle and so on, and in particular, to a technique for keeping an optimal amount of lubricating oil in the compressor.

BACKGROUND ART

In many cases, a compressor used for a refrigeration cycle has a compression portion and a motor chamber inside an airtight container, where the compression portion is driven via a rotary drive axis of the motor. The compression portion compresses a low-pressure refrigerant let into an airtight operation chamber to a high-pressure refrigerant by reducing its airtight capacity.

As the compression portion drives at high speed and high temperature, lubricating oil is pooled in the bottom of the motor chamber. Under ordinary circumstances, the lubricating oil is supplied to a refrigerant compression chamber through a suction opening provided inside the rotary drive axis and lubricates a bearing of the rotary drive axis and a sliding surface of a refrigerant compressing portion to be returned thereafter to the bottom of the motor chamber by going through a waste oil passage inside a main frame.

When returning the lubricating oil having lubricated the compression portion to the bottom of the airtight container, there are the cases where, if the lubricating oil contacts discharge gas, it is discharged with the discharge gas outside the compressor. If a large amount of the lubricating oil is discharged outside the compressor, there is not only a possibility of causing mal-lubrication due to lack of the lubricating oil but also a possibility of reducing thermal efficiency of the refrigeration cycle due to the lubricating oil discharged to the refrigeration cycle.

As one of the methods for preventing this, Patent Document 1 (Japanese Patent Application Publication No. 2000-80990) for instance provides the waste oil passage inside the main frame of the compression portion so as to draw the lubricating oil directly back to the bottom of the airtight container via a waste oil pipe for securely returning the lubricating oil from the waste oil passage to the bottom of the airtight container.

As another method, Patent Document 2 (Japanese Patent Application Publication No. 2002-161880) for instance provides the waste oil passage radially (horizontally) on the main frame and inserts an L-shaped waste oil pipe into the waste oil passage to discharge the waste oil. It is thereby possible to further reduce leakage of the lubricating oil at a joint portion with the main frame.

In the case of the above-mentioned compressors, however, the following problem remains unsolved. To be more specific, the waste oil pipe of these prior arts is overhung, and so a free end side (tip side) oscillates due to oscillation of the motor and hits an internal surface of the airtight container, which is one of the causes of generating abnormal noise.

As for the method described in Patent Document 1 in particular, the waste oil passage is formed in an axial direction so that there is a possibility that the waste oil pipe may fall off due to the oscillation of the motor and so on even if it is fixed by press fitting.

As for the method for preventing this, Patent Document 1 forms a flange portion for a retaining purpose in a part of the waste oil pipe. However, forming the flange portion in the pipe requires higher cost and longer time for assembly work.

As for the method described in Patent Document 2, the waste oil pipe is L-shaped. Therefore, the axial direction portion (the portion vertically extending) of the waste oil pipe is apt to swing circumferentially on press-fitting the waste oil pipe to the main frame, and there is a possibility that it may be displaced on inserting it into a notch of a stator core and result in defective assembly. Furthermore, even if the L-shaped waste oil pipe is press-fitted and fixed on the main frame, there is a possibility that the press-fitted portion may get loose and fall off if the waste oil pipe is touched in a following assembly stage.

There is also a method for preventing this oscillation whereby a part of the waste oil pipe is fixed by a subframe or the like provided on the bottom side of the airtight container. It cannot be denied, however, that fixtures for fixing it require cost and assembly work takes a lot of effort.

SUMMARY OF THE INVENTION

Thus, the present invention has been made to solve the above-mentioned problems, and an object thereof is to provide at a low price a compressor capable of preventing a waste oil pipe from falling off and curbing reduction in an amount of lubricating oil and oscillation of the pipe.

To attain the above-mentioned object, the present invention has a number of characteristics indicated below. A compressor including a compression portion and a motor placed on an underside of the compression portion for driving the compression portion via a rotary drive axis in an airtight container and having lubricating oil pooled in a bottom of the airtight container sucked up by the compression portion via a suction opening in the rotary drive axis and returned to the bottom of a motor chamber by going through a waste oil passage formed radially in a main frame of the compression portion, wherein: the waste oil passage has a waste oil pipe for returning the lubricating oil to the bottom of the motor chamber coupled thereto; the waste oil pipe consists of an L-shaped pipe having an inserting portion to be inserted into the waste oil passage from a radial direction of the airtight container and an oil leading portion leading to the bottom of the airtight container through a side of the motor bent almost in an L-shape via a bending portion; and at least a part of the waste oil pipe is in contact with an internal surface of the airtight container.

According to this, a part of the oil leading portion of the L-shaped waste oil pipe is mounted in contact with the internal surface of the airtight container so that movement of the waste oil pipe can be easily constrained and besides, assembly work can be easily performed.

As a preferable embodiment, it is desirable that the bending portion be bent at a sharp angle and the bending portion between the inserting portion and the oil leading portion be in contact with the internal surface of the airtight container. The bending portion is bent at an obtuse angle and a part of the oil leading portion is in elastic contact with the internal surface of the airtight container.

According to this, it is possible, by bending the bending portion of the waste oil pipe at a sharp angle, to fix the bending portion in contact with the internal surface of the airtight container. Inversely, it is possible, by bending the bending portion at an obtuse angle, to have a tip side of the oil leading portion jut out on the airtight container side so as to fix that portion in contact with the internal surface of the airtight container.

The oil leading portion is provided with a curvature portion for putting the part of the oil leading portion in contact with a part of a peripheral surface of the motor.

According to this, it is possible, by having the curvature portion having the part of the oil leading portion of the waste oil pipe further bent, to put the waste oil pipe in contact with the peripheral surface of the motor in addition to the internal surface of the airtight container so as to support the waste oil pipe more securely by supporting it at three points.

Furthermore, it is desirable to have a step portion for prescribing a position of the inserting portion provided in the waste oil passage and further have the inserting portion press-fitted in the waste oil passage.

According to this, it is possible, by providing the step portion for prescribing the position of the inserting portion in the waste oil passage, to position a radial travel distance of the waste oil pipe securely. It is further possible, by press-fitting the inserting portion of the waste oil pipe in the waste oil passage, to prevent the waste oil pipe from falling off.

As another embodiment, a compressor including a compression portion and a motor placed on an underside of the compression portion for driving the compression portion via a rotary drive axis in an airtight container and having lubricating oil pooled in a bottom of the airtight container sucked up by the compression portion via a suction opening in the rotary drive axis and returned to the bottom of the motor chamber by going through a waste oil passage formed radially in a main frame of the compression portion, wherein: the waste oil passage has a waste oil pipe for returning the lubricating oil to the bottom of the motor chamber coupled thereto; the waste oil pipe consists of an L-shaped pipe having an inserting portion to be inserted into the waste oil passage from a radial direction of the airtight container and an oil leading portion leading to the bottom of the airtight container through a side of the motor bent almost in an L-shape via a bending portion; and the main frame has a supporting groove having a tight holding surface for tightly holding the bending portion and/or the oil leading portion.

As a preferable embodiment, a second tight holding surface for tightly holding the side of the oil leading portion with the internal surface of the airtight container is provided in the supporting groove.

According to this, it is possible, by providing the supporting groove having the first and second tight holding surfaces for tightly holding the inserting portion and the side of oil leading portion of the waste oil pipe in the waste oil passage, to fix the waste oil pipe by sandwiching it with the supporting groove without putting the oil leading portion of the waste oil pipe in contact with the internal surface of the airtight container.

DETAILED DESCRIPTION

Figure 1:
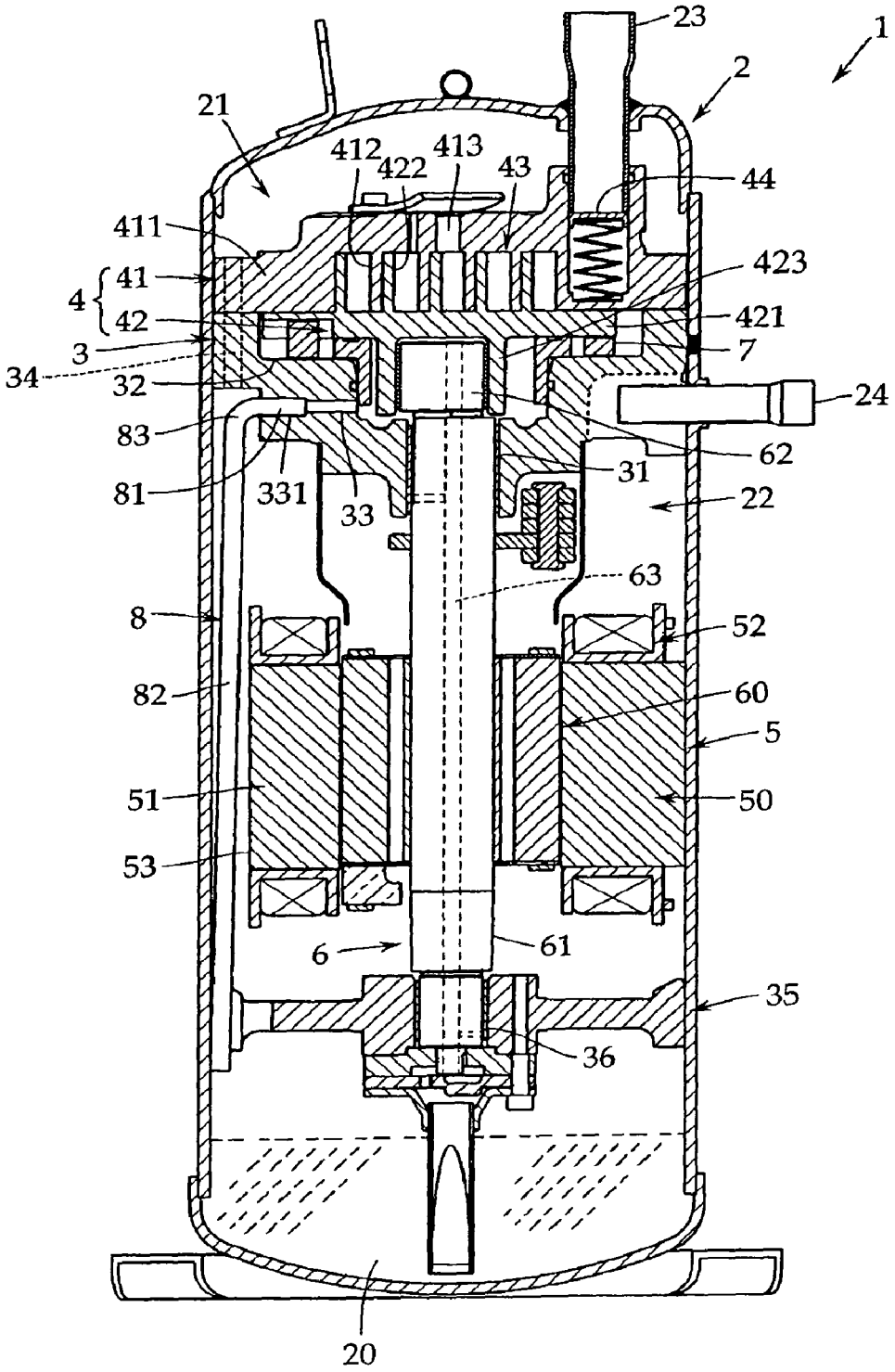
FIG. 1 is a sectional view schematically showing an internal structure of a compressor according to an embodiment of the present invention.

Next, embodiments of the present invention will be described by referring to the drawings. FIG. 1 is a sectional view schematically showing an internal structure of a compressor according to an embodiment of the present invention. The present invention is not limited thereto. In the following description of the embodiments, the compressor is a scroll compressor for engaging spiral scroll laps mutually to form an operation chamber.

The scroll compressor 1 consists of a vertically placed cylindrical airtight container 2, and is laid out into a compression chamber 21 and a motor chamber 22 inside having a main frame 3 in between.

The compression chamber 21 is provided with a refrigerant compressing portion 4 consisting of a fixed scroll 41 and a swirl scroll 42. The motor chamber 22 is provided therein with a motor 5 for driving the swirl scroll 42 via a rotary drive axis 6.

The fixed scroll 41 has spiral scroll laps 412 integrally mounted on a lower surface of a disc-like end plate 411, and a discharge opening 413 for discharging a high-pressure refrigerant generated inside is provided approximately at its center.

The swirl scroll 42 has spiral scroll laps 422 integrally formed on a top surface of a disc-like end plate 421, and a boss 423 for having a crankshaft 62 of the rotary drive axis 6 inserted therein is formed at the center of a backside of the end plate 421.

An airtight operation chamber 43 for compressing the refrigerant inside is formed by mutually engaging the scroll laps 412 and 422 of the fixed scroll 41 and swirl scroll 42.

With reference to FIG. 1, a subframe 35 for supporting the other end side of the rotary drive axis 6 is provided in the bottom of the airtight container 2. The subframe 35 has a disc element fixed along an internal surface of the airtight container 2 and also has a bearing portion 36 for axially supporting the rotary drive axis 6 at the center.

The motor 5 is a motor of an inner rotor type including a stator 50 placed along an inner peripheral surface of the airtight container 2 and a rotor 60 placed concentrically at the center of the stator 50. As shown FIG. 2, the stator 50 comprises a stator core 51 having a number of teeth (not shown) placed concentrically and insulators 52 integrally mounted on both ends in the axial direction of the stator cores 51.

The stator core 51 consists of a large number of stamped disc-like electromagnetic steel sheets laminated along the axial direction, and is formed to have an outside diameter approximately the same as an inside diameter of the airtight container 2. There are a number of the above-mentioned teeth provided on the inside diameter side of the stator core 51. A slot for winding a coil (neither is shown) is formed between the teeth.

The stator core 51 is provided with a communicating groove 53 for communicating between upper space (main frame 3 side) and lower space (subframe 35 side) of the motor 5 on a peripheral surface thereof. The communicating groove 53 consists of a concave groove formed over both ends in the axial direction of the stator core 51, and a number of the communicating grooves 53 are provided at predetermined intervals on the peripheral surface of the stator core 51.

With reference to FIG. 1, the rotor 60 of the motor 5 is placed concentrically at the center of the stator 50, and has the rotary drive axis 6 integrally mounted at its center. The rotor 60 may have a general configuration of which description is not necessary in this embodiment.

The rotary drive axis 6 of the motor 5 comprises a main axis 61 placed concentrically to the motor 5 and the crankshaft 62 placed eccentrically to the main axis 61. The crankshaft 62 is integrally formed on an upper end side of the main axis 61.

The main axis 61 is placed concentrically as an output axis of the motor 5 in the motor chamber 22, and has its lower end side inserted toward lubricating oil 20 pooled in the bottom of the airtight container 2. The main axis 61 has a suction opening 63 formed inside for the sake of supplying the lubricating oil 20 pooled in the motor chamber 22 to the sliding portions and bearing portion of the compression chamber 21.

A part of the suction opening 63 is branched toward a bearing portion 31 of the main frame 3, and feeds a part of the lubricating oil 20 having ascended in the suction opening 63 to the bearing portion 31 to lubricate it.

In this example, a scroll compressor 10 is an internal high-pressure type, and the airtight container 2 is provided in its upper part (compression chamber 21) with a refrigerant suction pipe 23 for drawing a low-pressure refrigerant having finished work in an unshown refrigeration cycle into the airtight operation chamber 43.

The refrigerant suction pipe 23 is connected to a side of the airtight operation chamber 43, and is provided with a back-flow valve 44 on its port for the sake of preventing the high-pressure refrigerant in the airtight operation chamber 43 from flowing back in the refrigeration cycle by going through the refrigerant suction pipe 23 on stopping the scroll compressor.

The motor chamber 22 of the airtight container 2 has connected thereto a refrigerant discharge pipe 24 for feeding the high-pressure refrigerant compressed by the refrigerant compressing portion 4 from the motor chamber 22 to the refrigeration cycle. A fixed amount of the lubricating oil 20 is pooled in the bottom of the airtight container 2.

Next, the main frame 3 has a disc-like frame of which periphery is fixed along the internal surface of the airtight container 2. At the center of the disc-like frame, the main bearing 31 is formed for the sake of axially supporting the main axis 61 of the rotary drive axis 6. On the top surface side of the main frame 3, a housing concave portion 32 is formed for the sake of housing the end plate 421 of the swirl scroll 42 via an Oldham's ring 7 for preventing rotation.

The center of the housing concave portion 32 is formed to be further lower by one step, where the crankshaft 62 of the rotary drive axis 6 and the boss 423 of the swirl scroll 42 are housed in a rotatable state.

The main frame 3 is provided with a waste oil passage 33 for returning the lubricating oil 20 fed by the rotary drive axis 6 and having finished work to the motor chamber 22 and further provided with a refrigerant passage 34 for further leading the high-pressure refrigerant generated in the airtight operation chamber 43 to the motor chamber 22.

The waste oil passage 33 consists of a horizontal opening (lateral opening) radially penetrating the main frame 3, and has a waste oil pipe 8 for leading the lubricating oil 20 to the bottom of the motor chamber 22.

The waste oil passage 33 has a slot 331 for inserting the waste oil pipe 33 formed on a discharge side thereof. The slot 331 has the inside diameter almost the same as the outside diameter of the waste oil pipe 8, is formed to have the diameter slightly larger than the waste oil passage 33, and has a stepped surface formed at the end for the sake of prescribing an insertion amount of the waste oil pipe 8.

The waste oil pipe 8 consists of a metallic pipe such as stainless steel for instance, and includes an inserting portion 81 for having one end thereof inserted into the waste oil passage 33 from a circumferential direction of the airtight container 2 and an oil leading portion 82 leading to the bottom of the airtight container 2 through the communicating grooves 53 on a stator side of the motor 5, which are formed almost in an L-shape via a bending portion 83. The inside diameter of the waste oil pipe 8 is arbitrarily changed according to specifications of the compressor 1. It may be made of a resin as a material.

Length of the inserting portion 81 of the waste oil pipe 8 is decided by an insertion amount into the slot 331. Similarly, the length of the oil leading portion 82 on the other end is decided by height of the airtight container 2. In this example, the bending portion 83 is bent at an obtuse angle ($\theta>90°$) and the tip side of the oil leading portion 82 (lower end side in FIG. 1) is in elastic contact with the airtight container 2 along the internal surface.

According to this, the oil leading portion 82 of the waste oil pipe 8 is in contact with the airtight container 2, and so it is possible to securely prevent the waste oil pipe 8 from running wild due to oscillation during compression operation and so on and generating abnormal noise or coming off. Furthermore, it is possible to reduce production cost because the waste oil pipe 8 is not fixed by using welding or a jig.

In the case of putting the oil leading portion 82 side of the waste oil pipe 8 in contact with the internal surface of the airtight container 2, it is possible, for the sake of preventing the bending portion 83 from progressing in work hardening and weakening its elasticity resilience due to long-term use, to adjust a bending angle of the bending portion 83 and provide a contact location on the inserting portion 81 side as much as possible so as to resolve it.

Figure 2:
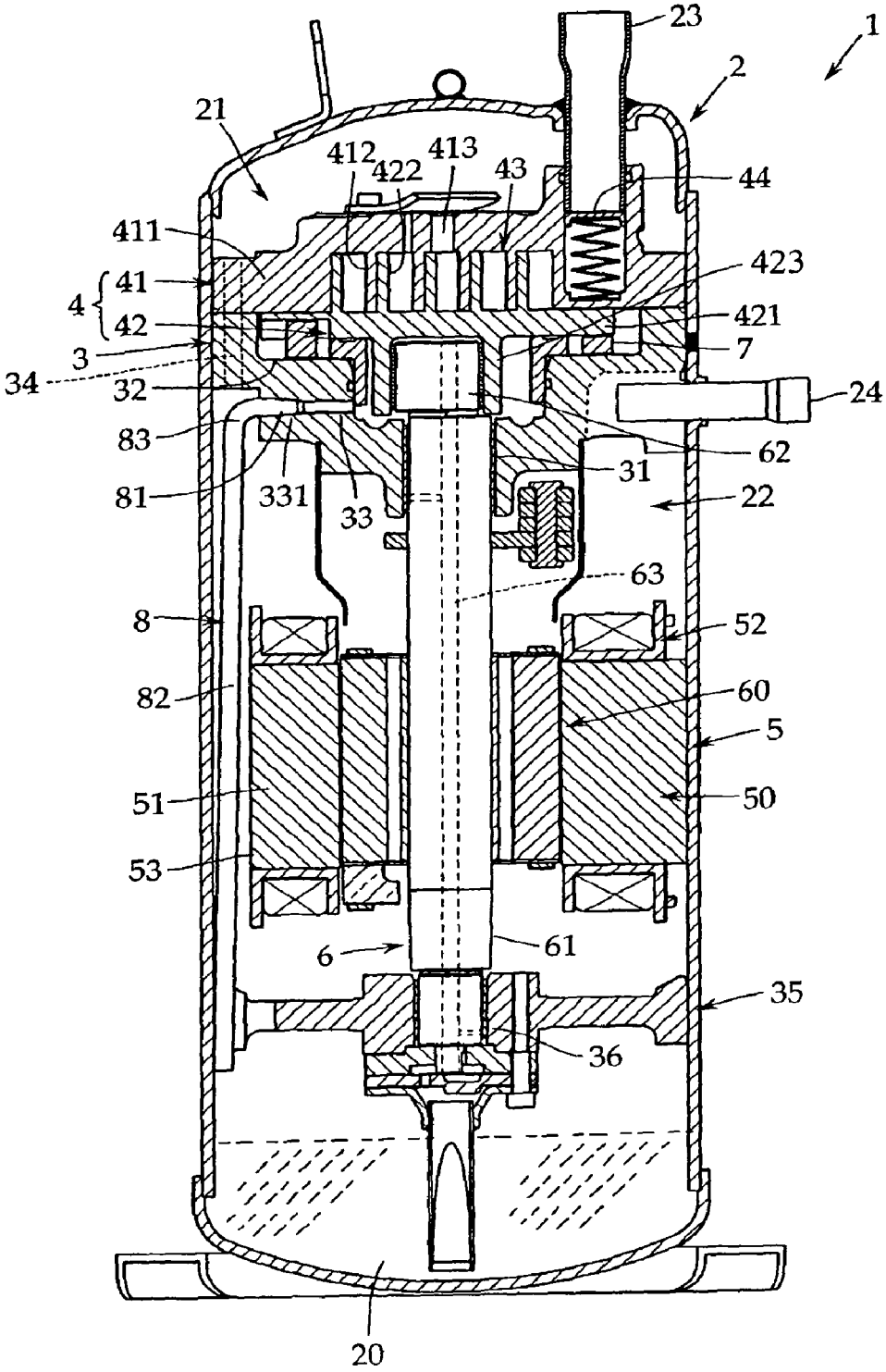
FIG. 2 is a sectional view showing a state of having a supporting pipe press-fitted in a main frame.

In this example, the slot 331 of the waste oil passage 33 is formed with almost the same diameter as the waste oil pipe 8. To fix it more securely, however, it is also feasible, as shown in FIG. 2, to render the slot 331 as a taper surface inclined toward an insertion direction and press-fit the inserting portion 81 of the waste oil pipe 8 therein. Such an embodiment is also included in the present invention.

Figure 3:
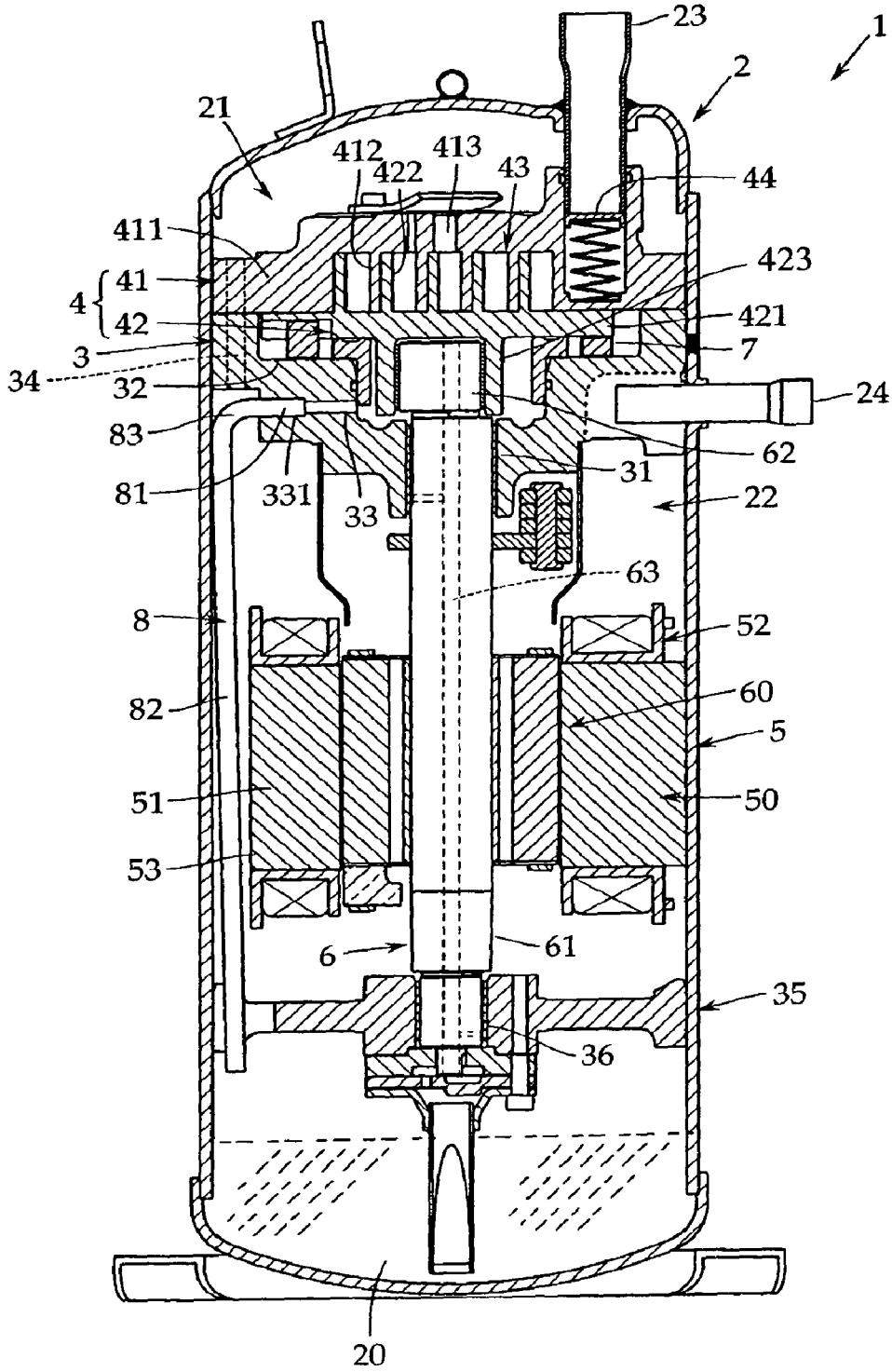
FIG. 3 is a sectional view showing a state of using the supporting pipe bent at an obtuse angle.

In this example, the bending portion 83 of the waste oil pipe 8 is bent at an obtuse angle ($\theta>90°$). However, it may also be bent at a sharp angle ($\theta<90°$). FIG. 3 shows a first deformed example of the compressor.

The bending portion 83 of the waste oil pipe 8 is bent at the sharp angle ($\theta<90°$) so that the bending portion 83 is in contact with the internal surface of the airtight container 2. Thus, the movement of the waste oil pipe 8 can be constrained likewise.

Figure 4:
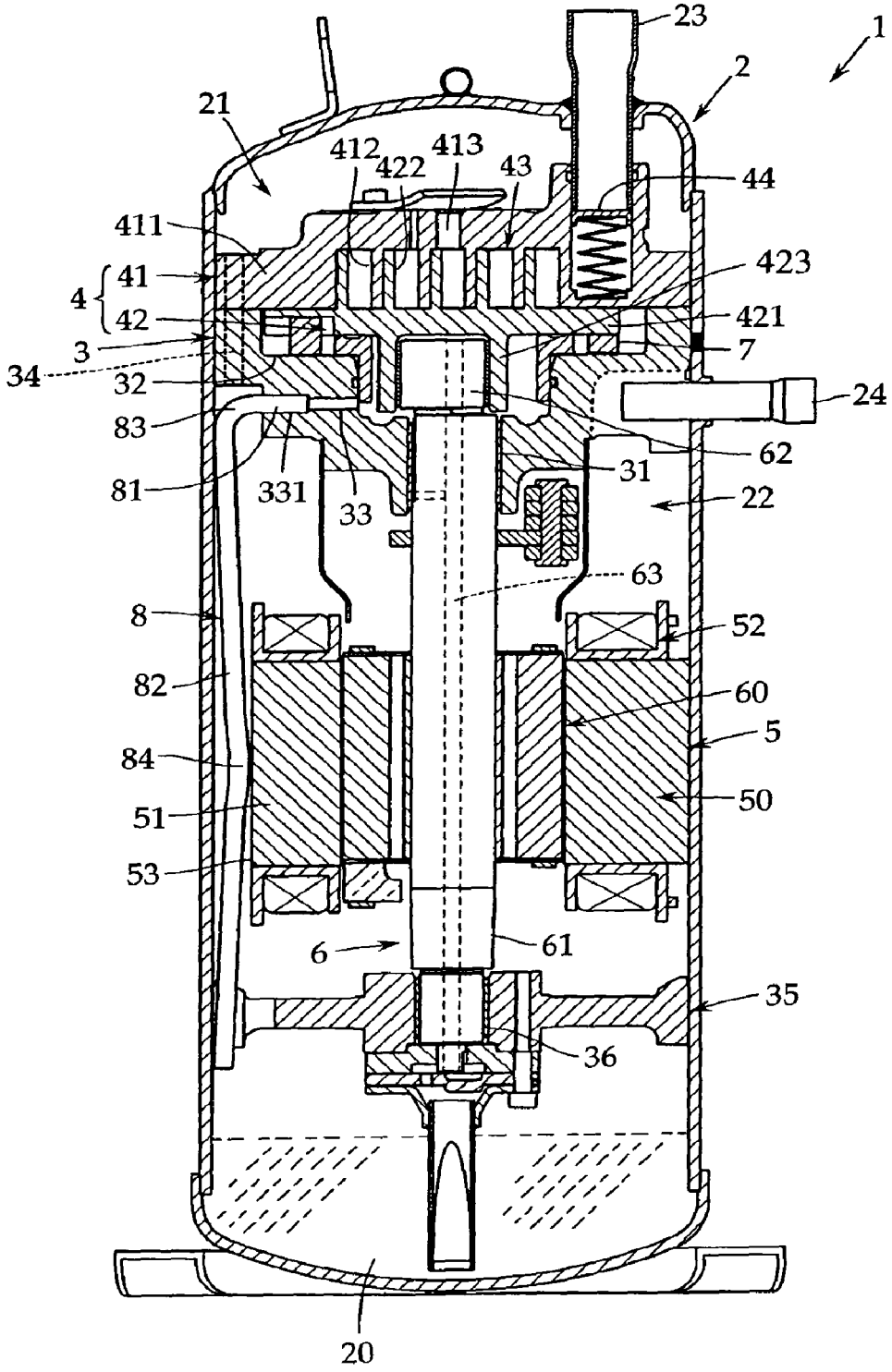
FIG. 4 is a sectional view showing a state of providing a second bending point to the supporting pipe and holding it at three points.

FIG. 4 is a second deformed example of the waste oil pipe 8. The waste oil pipe 8 has the bending portion 83 bent at the sharp angle to put the tip side of the oil leading portion 82 in contact with the internal surface of the airtight container 2. Furthermore, a curvature portion 84 is provided approximately at the center of the oil leading portion 82.

According to this, the bending portion 83 of the waste oil pipe 8 and the tip portion of the oil leading portion 8 are in contact with the airtight container 2 along the internal surface respectively, and in addition, the curvature portion 84 is in contact with the communicating groove 53 of the motor 5 along its side wall. Thus, a structure of having the waste oil pipe 8 supported at three points is created so that the movement of the waste oil pipe can be constrained more securely. Such an embodiment is also included in the present invention.

Figure 5A:
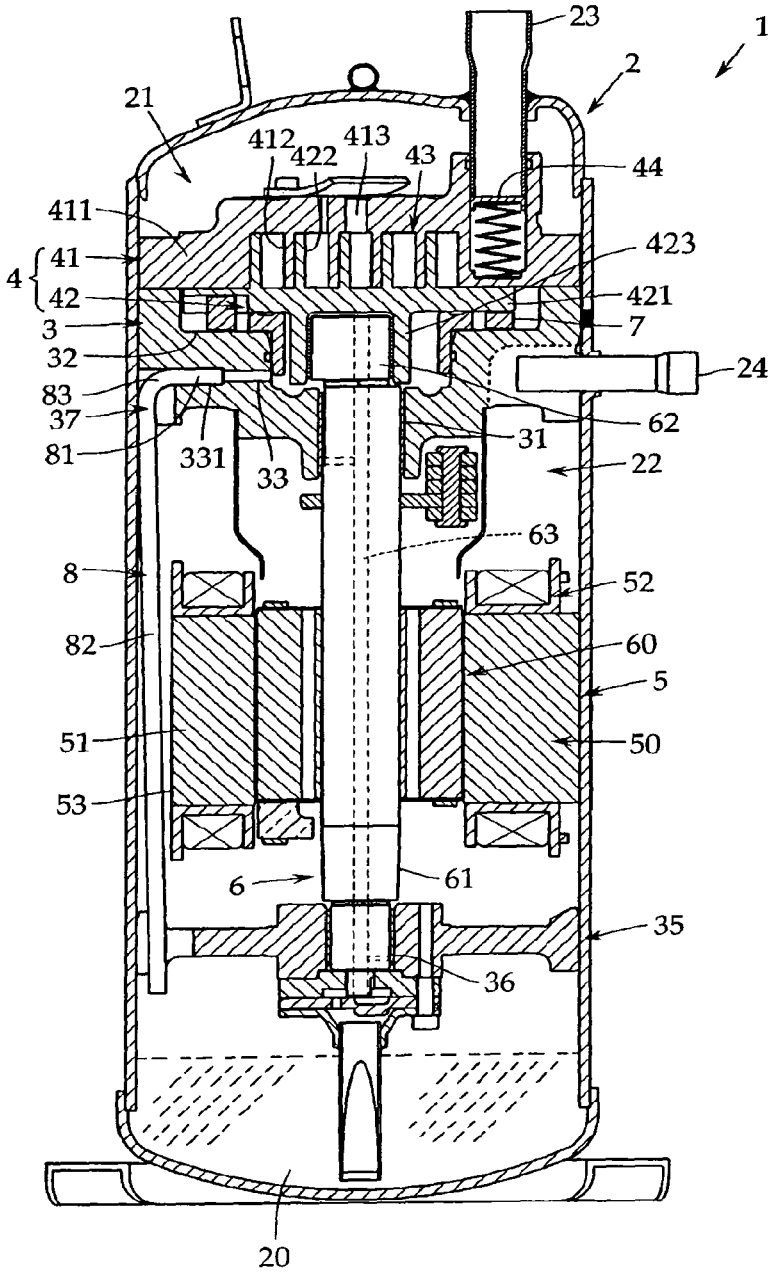
FIG. 5A is a sectional view showing a state of supporting a waste oil pipe in a supporting groove formed in the main frame.

Next, a third deformed example will be described by referring to FIGS. 5A, 5B and 6. The scroll compressor 1 is provided with a supporting groove 37 for tightly holding the side of the waste oil pipe 8 on an exit side of the waste oil passage 33 of the main frame 3.

Figure 5B:
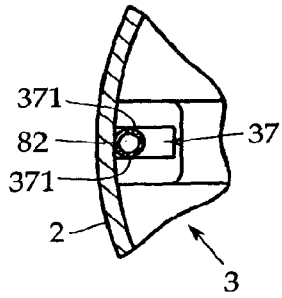
FIG. 5B is an enlarged major portion view of a supporting groove viewed from an axial direction.
Figure 6:
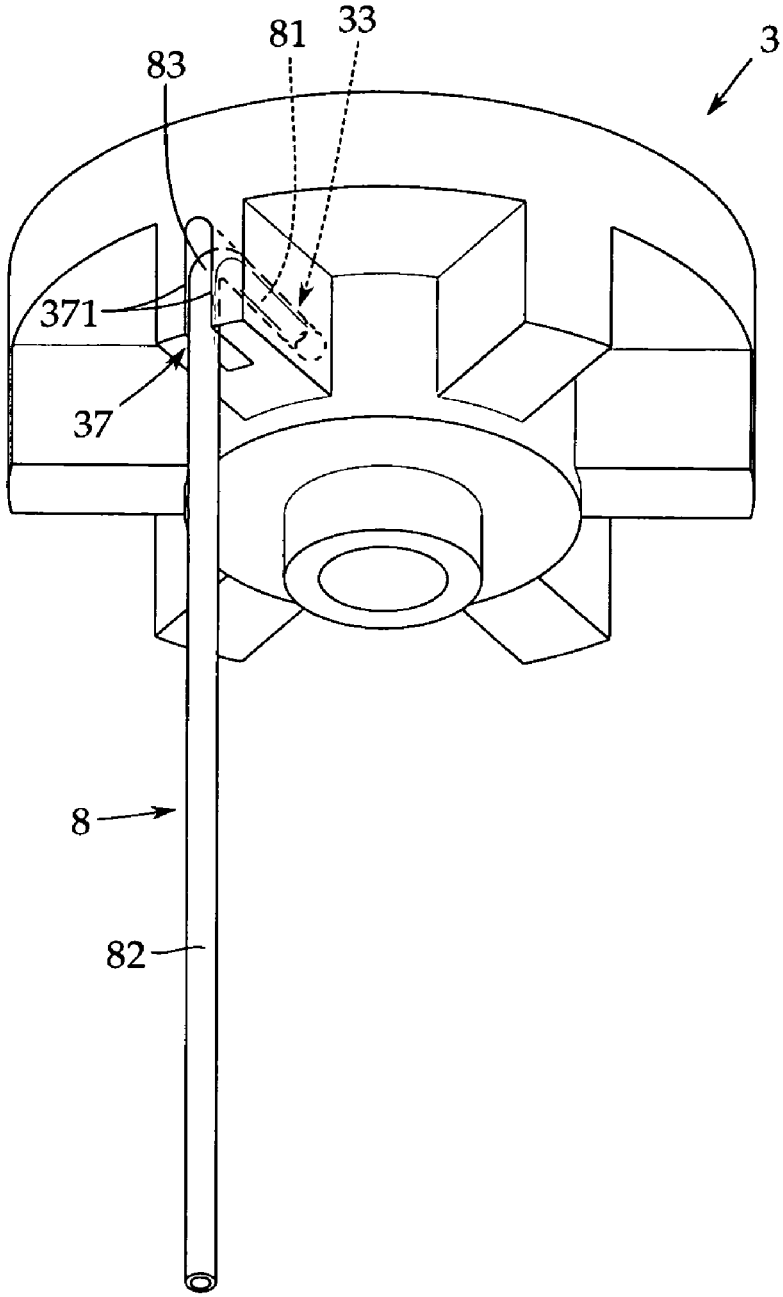
FIG. 6 is a perspective view showing a state of holding the waste oil pipe in the main frame.

As shown in FIG. 5B, the supporting groove 37 has its section formed in a U shape when viewing the main frame 3 from below (the motor 5 side), and comprises a pair of right and left tight holding surfaces 371, 371 for tightly holding the side in the axial direction of the waste oil pipe 8. The tight holding surfaces 371, 371 have their interplanar distance set to approximately the same width as the outside diameter of the waste oil pipe 8.

According to this, it is possible, by providing the supporting groove 37 and fitting the waste oil pipe 8 therewith, to regulate circumferential deflections of the waste oil pipe 8 and thereby improve position accuracy of the communicating grooves 53 of the waste oil pipe 8 and the stator core 50 so as to improve assembly accuracy.

Figure 7A:
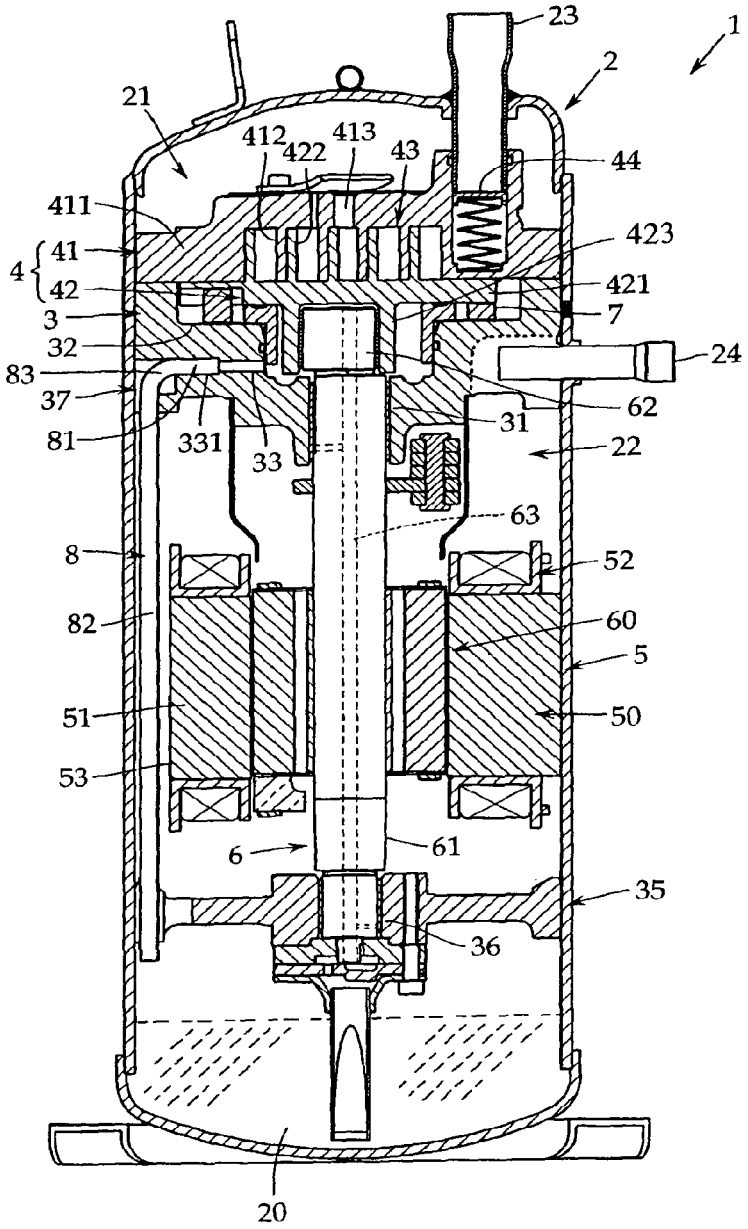
FIG. 7A is a sectional view showing a state of press-fitting and tightly holding the waste oil pipe in the supporting groove.
Figure 7B:
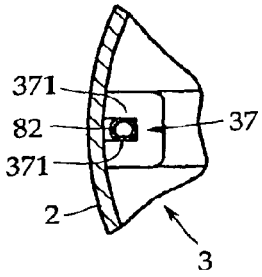
FIG. 7B is an enlarged major portion view of the supporting groove viewed from the axial direction.

The above-mentioned supporting groove 37 has the interplanar distance between the tight holding surfaces 371, 371 approximately the same as the pipe diameter. Otherwise, it is also possible, as shown in FIGS. 7A and 7B, to render the interplanar distance of the supporting groove 37 a little smaller than the pipe diameter and press-fit the waste oil pipe 8 therein.

According to this, it is possible not only to prevent the circumferential deflections of the waste oil pipe 8 more securely but also to constrain the waste oil pipe 8 itself. It is also possible to use an ordinary (right-angled) L-shaped pipe not to be bent at the sharp angle and obtuse angle of the waste oil pipe 8.

Figure 8A:
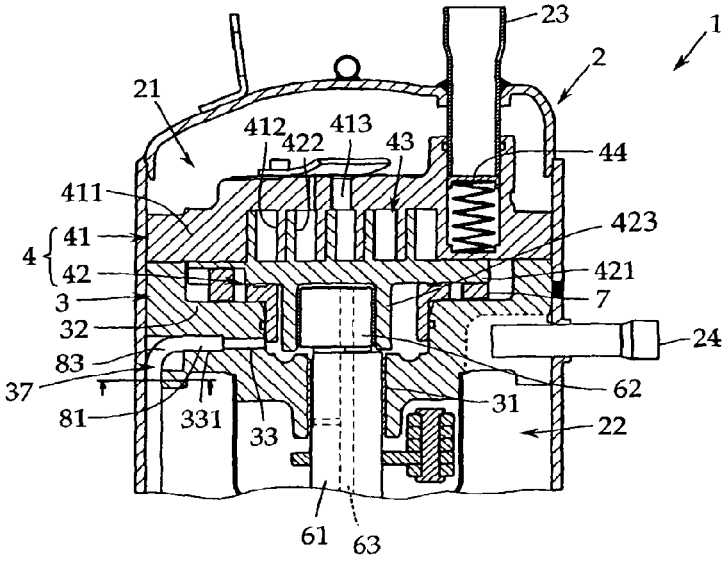
FIG. 8A is a sectional view showing a deformed example of the supporting groove.
Figure 8B:
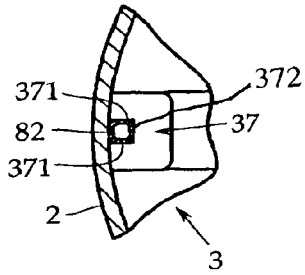
FIG. 8B is an enlarged major portion view of the supporting groove viewed from the axial direction.

To fix it more firmly, it is also possible, as shown in FIG. 8, to provide a second tight holding surface 372 on a circumferential side of the supporting groove 37 so as to tightly hold the circumferential side of the waste oil pipe 8 between the internal surface of the airtight container 2 and the second tight holding surface 372.

According to this, the waste oil pipe 8 is press-fitted and tightly held both radially and circumferentially so as to completely constrain the movement of the waste oil pipe 8. Such an embodiment is also included in the present invention.

Figure 9:
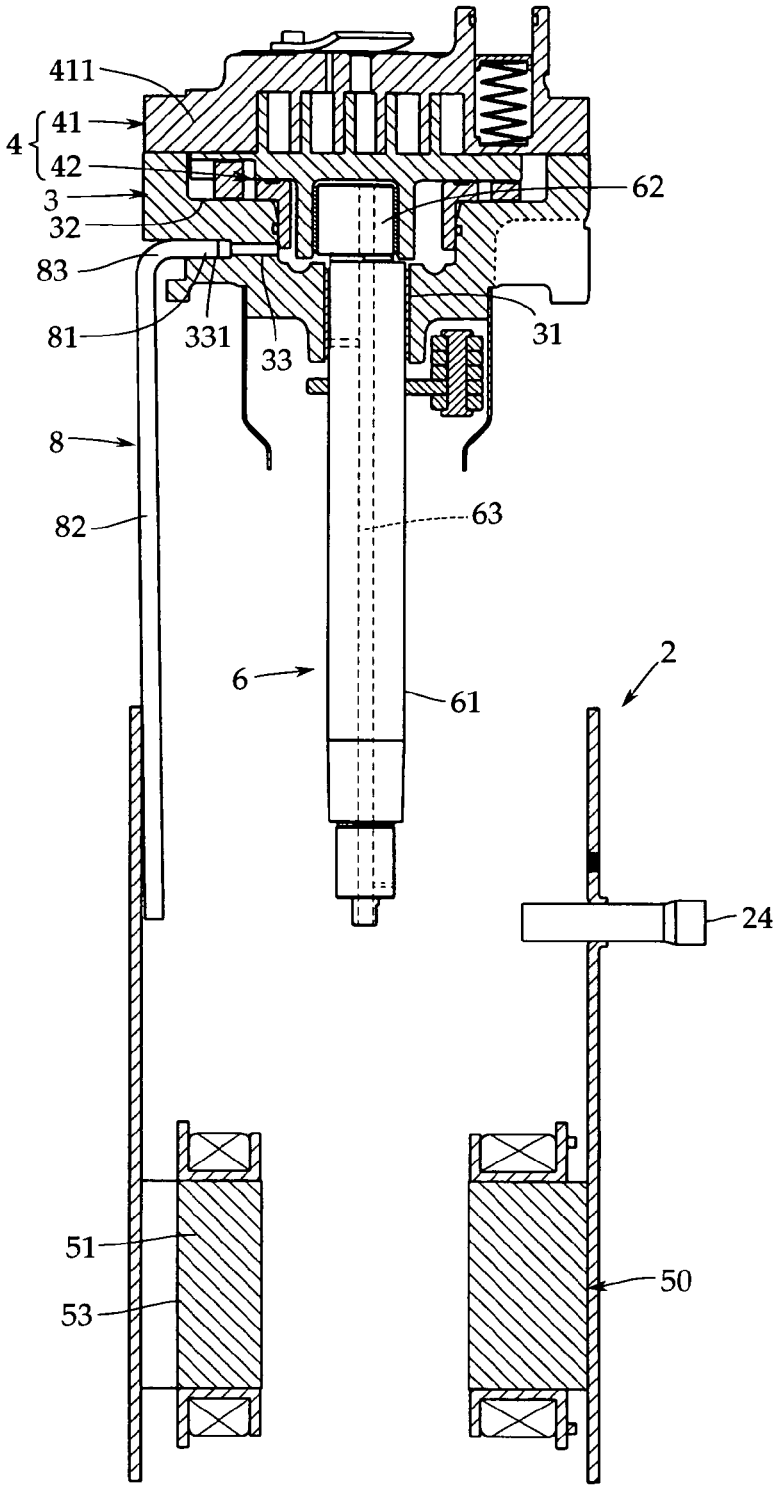
FIG. 9 is a schematic diagram for describing an assembly procedure of the compressor.

Next, an example of the assembly procedure of the compressor 1 will be described by referring to FIG. 9. First, the stator 50 of the motor 5 is integrally mounted on an inner circumferential surface of the airtight container 2 by shrinkage fitting. And then, a compression unit having the compressing portion 4 and rotary drive axis 6 pre-mounted thereon is installed on the main frame 3.

In addition, the inserting portion 81 of the waste oil pipe 8 is press-fitted in the waste oil passage 33 of the main frame 3. At this time, the tip portion of the waste oil pipe 8 is out of the inside diameter of the airtight container 2. To mount the compression unit, the tip of the waste oil pipe 8 jutting out is elastically pushed into the airtight container 2 first to be contained therein.

The compression unit is moved down as is along the communicating groove 53 of the motor 5 of the airtight container 2. After moving the compression unit to a predetermined position, the main frame 3 is integrally fixed on the airtight container 2 by spot welding or the like.

After fixing the waste oil pipe 8, the subframe 34 is inserted from below the airtight container 2, and is fixed likewise on the airtight container 2 by spot welding or the like. Lastly, the airtight container 2 is covered with an upper lid and a lower lid thereof to seal the inside completely so as to complete the scroll compressor 1. The rotary drive axis 6 has the unshown rotor 60 integrally mounted thereon and placed concentrically in the stator 50.

On operating the scroll compressor 1, the high-pressure refrigerant discharged into the compression chamber 21 is carried to motor upper space of the motor chamber 22 through the refrigerant passage 34 provided partially on the fixed scroll 31 and the main frame 4. The high-pressure refrigerant carried into the motor chamber 22 is fed from the refrigerant discharge pipe 24 to the refrigeration cycle.

In this case, a part of the refrigerant in the motor upper space is carried to motor lower space through the communicating grooves 54 of the stator 50 so as to refrigerate the motor 5. It is also possible to feed the high-pressure refrigerant forcibly to the lower space of the motor 5 by providing forced circulation means such as a centrifugal fan to the rotor 60.

The lubricating oil 20 pooled in the bottom of the airtight container 2 is sucked upward through the suction opening 63 provided in the rotary drive axis 6, where a part of it is branched on its way to lubricate the bearing portion 31 of the main frame 3. The rest of the lubricating oil 20 is supplied to the refrigerant compressing portion 4 to lubricate the sliding surfaces such as the scroll laps of the refrigerant compressing portion 4, and then it can return to the bottom of the airtight container 2 through the waste oil pipe 8 by way of the waste oil passage 33 from the housing concave portion 32 of the main frame 3.

According to the above-mentioned embodiments, the compressor 1 was described by exemplifying the scroll-type compressor. However, the compressor of the present invention may comprise a compression mechanism such as a rotary compressor. And the configuration of the compressor itself is not limited in particular if it has a basic configuration for holding the waste oil pipe 8 by means of the main frame 3.

The present application is based on, and claims priority from, Japanese Application Serial Number JP2004-321530, filed Nov. 5, 2004, the disclosure of which is hereby incorporated by reference herein in its entirety.

The invention claimed is:

1. A compressor comprising:

a compression portion, a motor placed at an underside of the compression portion for driving the compression portion via a rotary drive axis, an airtight container retaining the compression portion and the motor and having lubricating oil pooled in a bottom of the airtight container to be sucked up by the compression portion via a suction opening in the rotary drive axis and returned to the bottom of a motor chamber by flowing through a waste oil passage formed radially in a main frame of the compression portion, and a waste oil pipe for returning the lubricating oil from the waste oil passage to the bottom of the motor chamber, wherein the waste oil pipe is an L-shaped pipe having an inserting portion to be inserted into the waste oil passage of the main frame from a radial direction of the airtight container and an oil leading portion leading to the bottom of the airtight container through a side of the motor, the L-shaped pipe being bent almost in an L-shape via a bending portion; and the main frame has a supporting groove having tight holding surfaces for tightly holding the at least one of the bending portion and the oil leading portion.

2. A compressor, comprising:

a compression portion, a motor placed at an underside of the compression portion for driving the compression portion via a rotary drive axis, an airtight container retaining the compression portion and the motor and having lubricating oil pooled in a bottom of the airtight container to be sucked up by the compression portion via a suction opening in the rotary drive axis and returned to the bottom of a motor chamber by flowing through a waste oil passage formed radially in a main frame of the compression portion, and a waste oil pipe for returning the lubricating oil from the waste oil passage to the bottom of the motor chamber, wherein the waste oil pipe is an L-shaped pipe having an inserting portion to be inserted into the waste oil passage of the main frame from a radial direction of the airtight container and an oil leading portion leading to the bottom of the airtight container through a side of the motor, the L-shaped pipe being bent almost in an L-shape via a bending portion; and the main frame has a supporting groove having tight holding surfaces for tightly holding the at least one of the bending portion and the oil leading portion, wherein a second tight holding surface for tightly holding the side of the oil leading portion with the internal surface of the airtight container is provided in the supporting groove.

3. A compressor, comprising:

a compression portion, a motor placed at an underside of the compression portion for driving the compression portion via a rotary drive axis, an airtight container retaining the compression portion and the motor and having lubricating oil pooled in a bottom of the airtight container to be sucked up by the compression portion via a suction opening in the rotary drive axis and returned to the bottom of a motor chamber by flowing through a waste oil passage formed radially in a main frame of the compression portion, and a waste oil pipe for returning the lubricating oil from the waste oil passage to the bottom of the motor chamber, wherein the waste oil pipe is an L-shaped pipe having an inserting portion to be inserted into the waste oil passage of the main frame from a radial direction of the airtight container and an oil leading portion leading to the bottom of the airtight container through a side of the motor, the L-shaped pipe being bent almost in an L-shape via a bending portion; and the main frame has a supporting groove having tight holding surfaces for tightly holding the at least one of the bending portion and the oil leading portion, wherein the supporting groove is formed vertically in the main frame under the waste oil passage extending radially.

* * * * *